US005397051A

United States Patent [19]

Liu et al.

[11] Patent Number: 5,397,051

[45] Date of Patent: Mar. 14, 1995

[54] CAKE BOX

[76] Inventors: Yuan-Shin Liu, 11th-1 Floor, No. 90, Fu Hsin S. Road, Sec. 1, Tah An District, Taipei; Richard C. H. Chang, 19, Alley 2, Lane 685, Chung Cheng Road, Fuan Yuan City, Taichung Hsien, both of Taiwan, Prov. of China

[21] Appl. No.: 115,140

[22] Filed: Sep. 2, 1993

[51] Int. Cl.[6] ..... B65D 5/24

[52] U.S. Cl. ..... 229/109; 229/125.28; 229/163; 229/171; 229/186; 229/906

[58] Field of Search ..... 229/109, 110, 125.28, 229/163, 171, 186, 902, 906; 426/128, 130

[56] References Cited

U.S. PATENT DOCUMENTS

| | | | |
|---|---|---|---|
| 978,569 | 12/1910 | Elkin | 229/171 |
| 2,072,371 | 3/1937 | Kaplon | 229/125.28 |
| 2,295,478 | 9/1942 | Jason, Jr. | 426/128 |
| 2,407,118 | 9/1946 | Waters | 229/110 |
| 2,762,547 | 9/1956 | Van Dyke | 229/171 |
| 4,583,680 | 4/1986 | Gordon et al. | 229/163 |
| 4,684,024 | 8/1987 | Ebrahim et al. | 229/906 |
| 4,705,163 | 11/1987 | James | 426/128 |
| 4,776,459 | 10/1988 | Beckerman et al. | 229/906 |
| 4,801,077 | 1/1989 | Sweatt, III et al. | 229/906 |

*Primary Examiner*—Gary E. Elkins

*Attorney, Agent, or Firm*—Bacon & Thomas

[57] ABSTRACT

The present invention relates to a paper-made cake box which includes a lower seat and a corresponding upper cover. Both the lower seat and the upper cover are formed from a paper board made of pure fiber and additives laminated to an adequate thickness and coated with polyethylene to meet the FDA regulations. The paper board for the lower seat is cut to a substantially circular or polygonal shape and embossed with folding lines which define a polygonal bottom section and several wall sections adjoining the bottom section at the folding lines. Each of the wall sections is divided by two parallel folding lines into an inner wall section, an outer wall section and a flange section. Every two adjacent wall sections contain a corner connection section which is sector-shaped and divided by several radially extended folding lines, a transverse folding line and a triangular opening into inner folding plate sections, outer folding plate sections, and edge folding plate sections which are respectively adjacent to the inner wall, outer wall and flange sections, whereby the inner, outer and edge folding plate sections can be folded and heat-sealed on the wall sections, making the same folded and upright to form a partition having an inverted V-shaped cross section around the bottom section and a circle of horizontally outward extended flanges surrounding a bottom portion of the upright partition.

2 Claims, 4 Drawing Sheets

CAKE BOX

BACKGROUND Of THE INVENTION

The present invention relates to a cake box, and more particularly to a paper-made cake box including a lower seat and a corresponding upper cover suitable for fitting onto and covering the lower seat. Each of the lower seat and upper cover is formed from a paper board which has an adequate thickness and is cut into a predetermined pattern, wherein the paper board for the lower seat is substantially circular or polygonal and embossed with folding lines which define a polygonal bottom section and several wall sections adjoining the bottom section at the folding lines. Each two adjacent wall sections contain a corner connection section, whereby the paper board can be folded and-heat-sealed to form a basin-like bottom of the lower seat, a circle of partition with a reverse V-shaped cross section, and a circle of horizontally outward extended flange around the basin-like bottom of the lower seat. The space under the reverse V-shaped partition permits multiple lower seats of the cake boxes to be superposed on one another for convenient transfer and storage.

Conventional cake boxes are mainly made of paper or polymer, wherein the polymer-made cake box is integrally formed from a foaming material and includes a lower seat formed with a recessed bottom and a corresponding upper cover suitable for fitting onto and covering the upper periphery of the lower seat. Such cake box usually has vertically walls which might damage decoration formed on the periphery of the cake contained in the cake box, especially a large cake, if the cake box is tilted. Moreover, neither the upper cover nor the lower seat of such cake box can be superposed on one another for convenient transfer and storage. In addition, such cake box is not subject to natural decomposition after they are used and discarded, and therefore, will cause serious detriment to the whole environment. Therefore, the polymer-made cake boxes are gradually substituted by paper-made cake boxes.

A conventional paper-made cake box includes a lower seat and a corresponding upper cover suitable for fitting onto and covering the lower seat. Each of the lower seat and upper cover is formed from several layers of cardboard which have a certain thickness and are cut to different patterns. The cardboard layers are folded and sealed to form the cake box for containing various kinds of cakes. Although the paper-made cake box is free from the problem of environmental pollution, the shortcomings existed in the above polymer-made cake box, particularly that the lower seats cannot be superposed on one another, still exist in the conventional paper-made cake box. Moreover, the upper cover and lower seat are formed and folded from multiple layers of different paper board, the manufacture of such cake box is complicated. Therefore, an improved paper-made cake box is desirable.

It is therefore tried by the applicant to develop a paper-made cake box which is easy in manufacture, secure in structure, convenient in use, and which can eliminate the shortcomings existing in the conventional paper-made cake box.

SUMMARY OF THE INVENTION

It is a primary object of the present invention to provide a paper-made cake box which includes a lower seat and a corresponding upper cover suitable for fitting onto and covering the lower seat. Each of the lower seat and upper cover is formed from a single sheet of paper board which has a predetermined thickness and is cut into a predetermined pattern, wherein the paper board for the lower seat is substantially circular or polygonal and embossed with folding lines which define a polygonal bottom section and several wall sections adjoining the bottom section at the folding lines. Each two adjacent wall sections contain a corner connection section. Each of the wall sections is divided by two parallel folding lines into an inner wall section, an outer wall section and a flange section. Each corner connection section is sector-shaped and is embossed with several radially extended folding lines and a substantially transverse folding line, and is formed with an internal triangular opening such that each of the corner connection sections includes inner folding plate sections, outer folding plate sections, and edge folding plate sections, the two lateral sides of each of which are respectively adjacent to the inner wall, outer wall and flange sections, whereby the inner, outer and edge folding plate sections can be folded and heat-sealed on the outer wall sections, making the same upright to together with the bottom section form a basin-like bottom of the lower seat and with the inner wall sections define a generally circular partition having an inverted V-shaped cross section and thereby defining a space under it, and together with the flange sections to form a circle of horizontally and outwardly extended flange around the basin-like bottom of the lower seat. When the cake box is used to contain a cake, the cake is restricted from shifting by the upright but slightly outward inclined inner wall sections of the cake box and therefore, the peripheral decoration of the cake will not collide with the inner wall sections and be damaged. In addition, the space under the circle of inverted V-shaped partition permits multiple lower seats of the cake boxes to be superposed on one another for convenient transfer and storage.

It is a further object of the present invention to provide the above cake box, wherein the periphery of the bottom section of the lower seat may be differently shaped and the numbers of the wall sections and corner connection sections may be accordingly increased or reduced to give the cake box a lower seat of different shapes for packing various cakes in different shapes.

It is still a further object of the present invention to provide the above cake box, wherein the widths of the inner and outer wall sections and the inner and outer folding plate sections may be varied to give the lower seat different heights. Moreover, the materials for making the cake can be directly placed and baked in the lower seat of sale. Therefore, the conventional de-molding procedure after the baking can be saved.

It is still a further object of the present invention to provide the above cake box, wherein the periphery of the upper cover is shaped corresponding to that of the lower seat for fitting on and covering the lower seat, and is formed with several downwardly extending projections corresponding to slots formed on the flange sections of the lower seat such that the projections can be inserted into the slots and bent to securely associate the upper cover with the lower seat.

It is still a further object of the present invention to provide the above cake box, wherein the flange sections of the lower seat are formed with several cuts at an outer periphery thereof so that When the upper cover is fitted on the lower seat, a string can be used to tie the upper cover and lower seat together by passing through the cuts.

BRIEF DESCRIPTION OF THE DRAWINGS

The structure, features, functions, and other objects of the present invention, and the technical means adopted to achieve the present invention can be best understood through the following detailed description of the preferred embodiment and the accompanying drawings wherein.

DETAILED DESCRIPTION OF THE PREFERRED EMBODIMENTS

Figure 1:
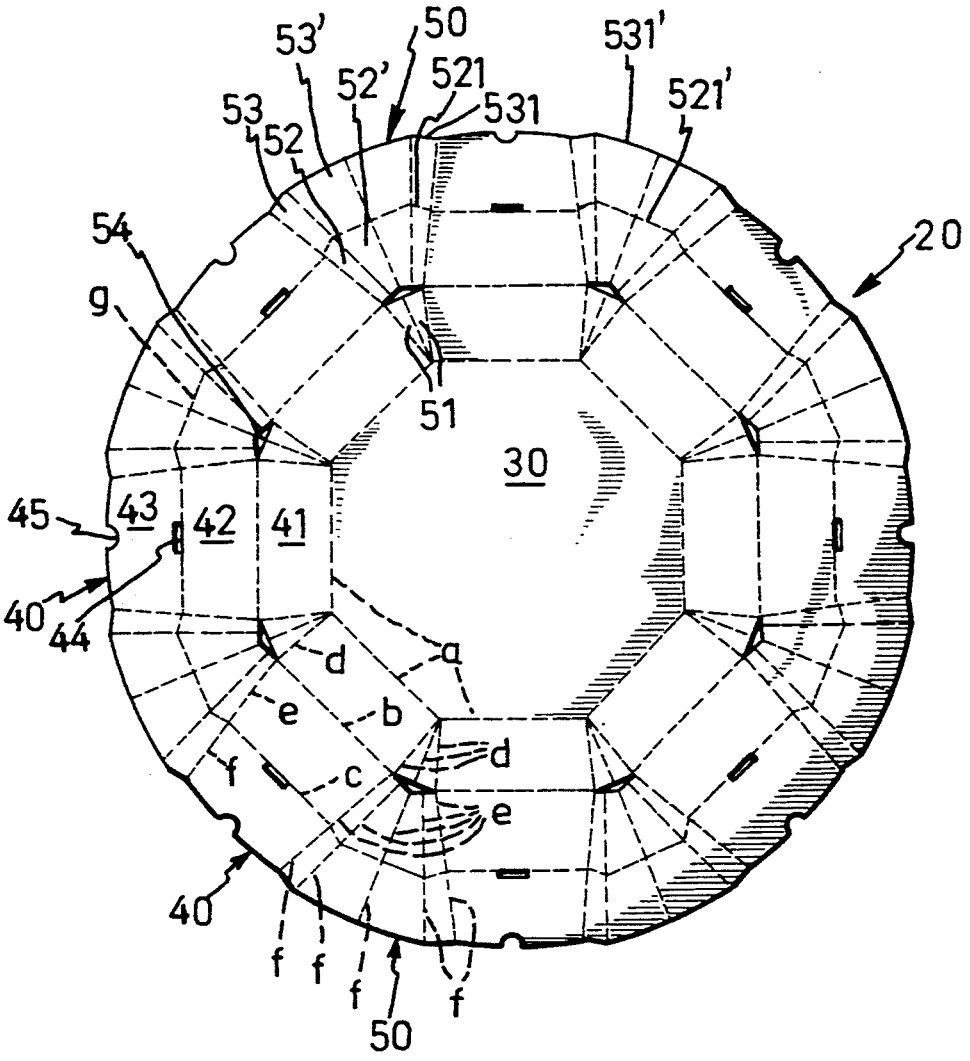
FIG. 1 is an unfolded paper pattern of a lower seat of the paper-made cake box according to the present invention.

The paper-made cake box of the present invention includes a lower seat 20 and a corresponding upper cover 10 suitable for fitting onto and covering the lower seat 20. Each of the lower seat 20 and upper cover 10 is formed from a paper board made of paper of pure fibers and additives being laminated to adequate thickness and coated with polyethylene to meet the FDA regulations. The paper board is cut into a predetermined pattern. The paper board for forming the lower seat 20 is substantially circular or polygonal in shape and is embossed with folding lines a, b, c, d, e, f, g which define an equilateral polygonal bottom section 30 (such as an equilateral octagon, an equilateral dodecagon, etc.) and several wall sections 40 outward extending from the sides of the bottom section 30. Each two adjacent wall sections 40 contain a sector corner connection 50, whereby the wall sections 40 and corner connection sections 50 can be folded about the folding lines a through g and heat-sealed to form the lower seat 20 having a basin-like bottom 30 and a partition 60 having an inverted V-shaped cross section and defining a space thereunder.

The space under the inverted V-shaped partition 60 permits multiple lower seats 20 to be superposed upon one another and thereby be stably and easily transferred and stored. Moreover, the materials for making the cake can be directly placed and baked in the bottom 30 of the lower seat 20 and baked cake can be displayed therein for sale. Therefore, the conventional de-molding procedure after the baking can be saved. The upper cover 10 having a periphery corresponding to that of the lower seat 20 can be securely fitted on the lower seat 20 to pack the cake.

Please now refer to FIG. 1 which shows an unfolded paper board for forming an octagonal lower seat 20 of the paper-made cake box of the present invention, wherein the paper board is embossed with several folding lines and which define a middle octagonal bottom section 30. Several wall sections 40 adjoin respective sides of the bottom section 30 at the folding lines a. Each wall section 42 is divided by two folding lines b and c parallel to the folding line a into an inner wall section 41, an outer wall section 42 and a flange section 43 sequentially positioned from inner side to outer side. At an inner and an outer side of the flange section 43 are respectively formed slot 44 and a cut 45.

Each corner connection 50 is embossed with radially extended folding lines d, e and f and a slightly outward projected transverse folding line g adjacent to the folding line c on the wall sections 40, and is formed with a triangular opening 54 between two adjacent folding lines b. Folding lines d, e, f, g, and the triangular opening 54 on each corner connection section 50 define from inner side to outer side a pair of laterally symmetrical inner folding plate sections 51, outer folding plate sections 52, 52', and edge folding plate sections 53, 53' that are laterally corresponding to an adjacent to the inner wall sections 41, the outer wall sections 42, and the flange sections 43, respectively. The edge folding plate sections 53' and the flange sections 43 each has a slightly curved outer edge which permits the folded lower seat 20 to approximate a circular shape.

Figure 2:
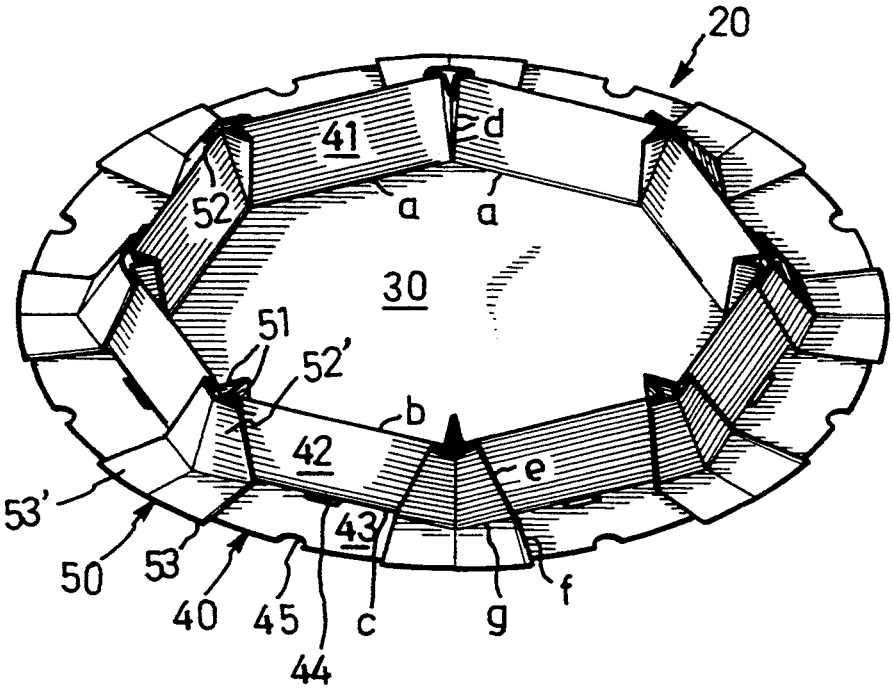
FIG. 2 shows the manner in which the lower seat of the cake box according to FIG. 1 is folded.
Figure 3:
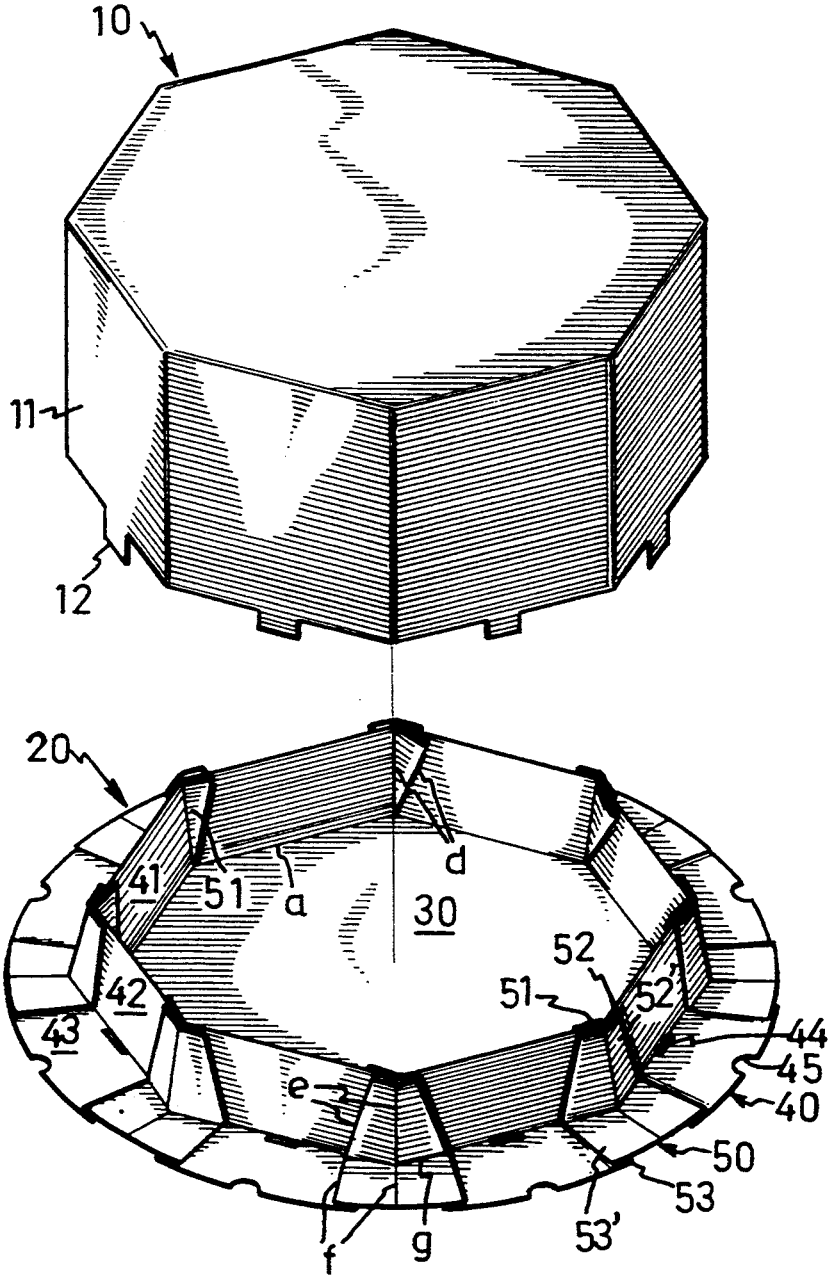
FIG. 3 is a perspective view showing the upper cover and the lower set of the present invention in a separate state.
Figure 5:
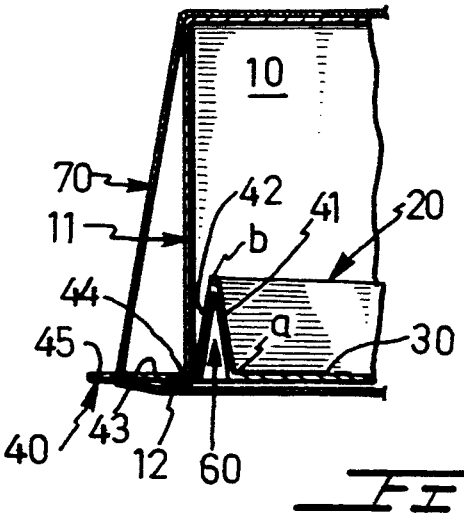
FIG. 5 is a fragmentary sectional view of FIG. 4 in which the upper cover is fitted onto the lower seat.

The inner folding plate sections 51 are two adjacent equilateral triangles which can be inward folded relative to each other and heat-sealed in place, causing the inner wall sections 41 to be slightly inclined when erect as shown in FIGS. 2, 3 and 5. The outer folding plate sections 52, 52' and the edge folding plate sections 53, 53' each has an outward projected portion 521' and 531', respectively. The wall sections 40 and the corner connection sections 50 can be outward folded about the folding lines b and the triangular openings 54. Meanwhile, the outer folding plate sections 52 are folded about the folding lines 3 and two distal sides thereof so that they can be separately heat-sealed on the outer wall sections 42, making the same upright and together with the inner wall sections 41 define a generally circular partition 60 with an inverted V-shaped cross section, forming a circular space thereunder, as shown in FIG. 5.

Please now refer to FIGS. 2 and 3, wherein the flange sections 43 and edge folding plate sections 53, 53' can be folded outward about the folding lines c and g, respectively, while the edge folding plate sections 53, 53' are folded about the folding lines f with two distal sides thereof heat-sealed on the adjacent flange sections 43, whereby the flange sections 43 and edge folding plate sections 53, 53' form a horizontally outward extended flange around a bottom portion of the outer wall sections 42 and outer folding plate sections 52, 52', permitting the lower seat 20 to be stably positioned. Furthermore, due to the slightly curved outer peripheries of the edge folding plate sections 53' and flange sections 43, the folded lower seat 20 will have a substantially circular outer periphery.

Figure 4:
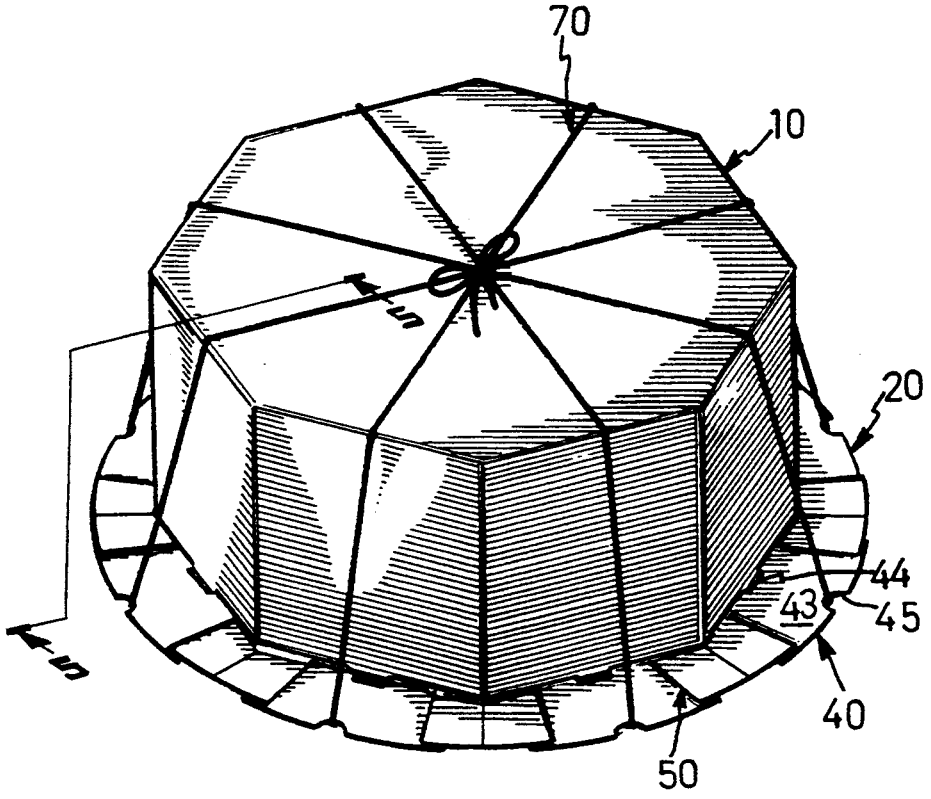
FIG. 4 is a perspective view showing the upper cover and the lower seat of the present invention in an associated state.

As shown in FIGS. 3 and 4, the upper cover 10 can be fitted onto the lower seat 20. The periphery of the upper cover 10 is shaped corresponding to that of the lower seat 20. The upper cover 10 has several walls 11 each of which is formed with a downward extended projection 12 corresponding to the slot 44 of the flange section 43, so that the projection 12 can be inserted thereinto and then bent to securely associate the upper cover 10 with the lower seat 20. Moreover, a string 70 can be used to tie the upper cover 10 and lower seat 20 together by passing through the cuts 45 of the flange sections 43.

Therefore, according to the above arrangements, the bottom section 30 of the lower seat 20 of the present invention may be differently shaped and the numbers of the wall sections 40 and corner connection sections 50 may be accordingly increased or reduced to form lower seats 20 of various shapes, such as a circle or a polygon. In addition, the widths of the inner and outer wall sections 41, 42 and the inner and outer folding plate sections 51 and 52, 52' may be changed to form lower seats 20 with different heights so as to be suitably used for packing various kinds of cake.

In conclusion, the paper-made cake box of the present invention can be easily manufactured with a beautiful appearance and conveniently used to securely pack various kinds of cakes in different shapes and volumes.

It is to be understood that the above description and drawings are only used for illustrating one embodiment of the present invention, and are not intended to limit the scope of the present invention. Any variation and derivation from the above description and drawings should be included in the scope of the present invention.

What is claimed is:

1. A cake box formed from a paper board made of laminated paper coated with polyethylene cut to a pattern in a predetermined configuration and embossed with a plurality of folding lines to define different sections thereon; said cake box comprising:

a lower seat comprising a substantially equilateral polygon-shaped bottom section, a plurality of wall sections adjoining each side of said bottom section at first folding lines, and corner connection sections between every two of said wall sections that are adjacent to each other; said wall sections each being divided by a second and a third folding lines parallel to said first folding line into an inner wall section, an outer wall section, and a flange section; said corner connection sections each being sector-shaped and being divided by radially extended fourth folding lines, a transversely extending fifth folding line, and a triangular opening therein into inner folding plate sections, outer folding plate sections, and edge folding plate sections which are respectively laterally adjacent to said inner wall sections, outer wall sections, and flange sections of adjoining wall sections; said inner, outer, and edge folding plate sections, when being folded outward at said fourth and fifth folding lines as well as said triangular openings, causing said inner, outer, and flange wall sections respectively adjacent to two lateral sides of said folding plate sections to turn outward and be folded about said second and said third folding lines, forming a generally circular upright partition having an inverted V-shaped cross section around said bottom section and a horizontally outwardly extending flange surrounding a bottom portion of said partition; and an upper cover having a periphery shaped corresponding to that of said lower seat.

2. A cake box as claimed in claim 1, wherein said upper cover is formed with a plurality of downwardly extending projections along a lower edge thereof; and said flange sections of said lower seat are formed with slots at locations corresponding to said downwardly extending projections of said upper cover so that said projections can be inserted into said slots and then bent to securely associate said upper cover with said lower seat.

* * * * *